US010035276B2

(12) United States Patent
Griffin et al.

(10) Patent No.: US 10,035,276 B2
(45) **Date of Patent: *Jul. 31, 2018**

(54) DEDICATED ATTACHMENT SYSTEMS FOR CONSUMER PRODUCTS

(71) Applicant: SHAVELOGIC, INC., Dallas, TX (US)

(72) Inventors: John W. Griffin, Moultonborough, NH (US); Craig A. Provost, Boston, MA (US); William E. Tucker, Attleboro, MA (US)

(73) Assignee: ShaveLogic, Inc., Dallas, TX (US)

( * ) Notice: Subject to any disclaimer, the term of this patent is extended or adjusted under 35 U.S.C. 154(b) by 66 days.

This patent is subject to a terminal disclaimer.

(21) Appl. No.: 15/611,652

(22) Filed: Jun. 1, 2017

(65) Prior Publication Data

US 2017/0266828 A1 Sep. 21, 2017

Related U.S. Application Data

(63) Continuation of application No. 15/094,108, filed on Apr. 8, 2016, now Pat. No. 9,669,555, which is a (Continued)

(51) Int. Cl.

| | |
|---|---|
| ***B26B 21/06*** | (2006.01) |
| ***B26B 21/52*** | (2006.01) |
| ***B26B 21/40*** | (2006.01) |

(52) U.S. Cl.

CPC ..... *B26B 21/521* (2013.01); *B26B 21/4081* (2013.01); *B26B 21/522* (2013.01); *Y10T 29/49826* (2015.01); *Y10T 83/04* (2015.04)

(58) Field of Classification Search

CPC .. B26B 21/4081; B26B 21/521; B26B 21/522

(Continued)

(56) References Cited

U.S. PATENT DOCUMENTS

| | | | |
|---|---|---|---|
| 1,299,096 | A | 4/1919 | Ames |
| 1,299,097 | A | 4/1919 | Ames |

(Continued)

FOREIGN PATENT DOCUMENTS

| | | |
|---|---|---|
| BR | 9905745 | 9/2000 |
| CN | 101612740 | 12/2009 |

(Continued)

OTHER PUBLICATIONS

Certified Translation of CN 101612740, published Dec. 30, 2009, Jian et al.

(Continued)

*Primary Examiner* — Omar Flores Sanchez

(74) *Attorney, Agent, or Firm* — Celia H. Leber; Leber IP Law

(57) ABSTRACT

Consumer products, e.g., shaving systems and toothbrushes, are disclosed which have a replaceable portion, e.g., a shaving assembly or a toothbrush head, that is removably mounted on a handle. The consumer products described herein include keyed structures on the handle and replaceable portion, the relative placement of which creates a unique interaction between the two parts. This unique interaction may, for example, be used to provide a dedicated attachment system for each specific customer of the manufacturer of the consumer product.

7 Claims, 12 Drawing Sheets

Related U.S. Application Data continuation of application No. 13/869,535, filed on Apr. 24, 2013, now abandoned.

(60) Provisional application No. 61/718,328, filed on Oct. 25, 2012.

(58) Field of Classification Search
USPC ..... 30/32, 50, 526, 527
See application file for complete search history.

(56) References Cited

U.S. PATENT DOCUMENTS

| | | | |
|---|---|---|---|
| 2,532,372 | A | 11/1948 | Sanders |
| 2,885,778 | A | 5/1959 | Randol |
| 2,967,354 | A | 1/1961 | Ahlborn |
| 3,031,757 | A | 5/1962 | Kramer |
| 3,067,513 | A | 12/1962 | Randol |
| 3,660,894 | A | 5/1972 | Sand |
| 3,768,162 | A | 10/1973 | Perry |
| 3,783,510 | A | 1/1974 | Dawidowicz et al. |
| 4,413,411 | A | 11/1983 | Trotta |
| 4,428,116 | A | 1/1984 | Chen et al. |
| 4,446,619 | A | 5/1984 | Jacobson |
| 4,574,625 | A | 3/1986 | Olasz et al. |
| 5,129,118 | A | 7/1992 | Walmesley |
| 5,146,814 | A | 9/1992 | Vasichek |
| 5,526,568 | A | 6/1996 | Copelan |
| 5,760,941 | A | 6/1998 | Young et al. |
| 5,787,586 | A | 8/1998 | Aprille et al. |
| 5,822,869 | A | 10/1998 | Metcalf et al. |
| 5,848,475 | A | 12/1998 | Hill et al. |
| 5,855,071 | A | 1/1999 | Apprille et al. |
| 5,921,562 | A | 7/1999 | Robison |
| 5,956,851 | A | 9/1999 | Apprille, Jr. et al. |
| 6,026,577 | A | 2/2000 | Ferraro |
| 6,035,535 | A | 3/2000 | Dischler |
| 6,203,644 | B1 | 3/2001 | Nagaura et al. |
| 6,237,232 | B1 | 5/2001 | Petricca et al. |
| 6,565,586 | B2 | 5/2003 | Harrold et al. |
| 6,886,262 | B2 | 5/2005 | Ohtsubo et al. |
| 7,134,368 | B2 | 11/2006 | Nagy |
| 7,137,203 | B2 | 11/2006 | Bressler et al. |
| 7,162,802 | B2 | 1/2007 | Benardeau et al. |
| 7,168,173 | B2 | 1/2007 | Worrick, III |
| 7,181,800 | B2 | 2/2007 | Lee |
| 7,275,461 | B2 | 10/2007 | Gherman et al. |
| 7,337,903 | B2 | 3/2008 | Lauri |
| 7,530,771 | B2 | 5/2009 | Kozak |
| 7,574,809 | B2 | 8/2009 | Follo et al. |
| 7,578,062 | B2 | 8/2009 | Blackburn |
| 7,703,361 | B2 | 4/2010 | Johnson et al. |
| 7,770,294 | B2 | 8/2010 | Bruno et al. |
| 7,913,393 | B2 | 3/2011 | Royle et al. |
| 8,033,023 | B2 | 10/2011 | Johnson et al. |
| 8,205,344 | B2 | 6/2012 | Stevens |
| 8,381,406 | B2 | 2/2013 | Miyazaki |
| 8,567,966 | B2 | 10/2013 | Hubbs |
| 8,789,282 | B2 | 7/2014 | Wilson et al. |
| 9,486,930 | B2 | 11/2016 | Provost et al. |
| 9,498,892 | B2 | 11/2016 | Nakasuka et al. |
| 2003/0204915 | A1 | 11/2003 | Colemen, Jr. |
| 2005/0123342 | A1 | 6/2005 | Bressler et al. |
| 2005/0144786 | A1 | 7/2005 | Bressler et al. |
| 2005/0193572 | A1 | 9/2005 | Gilder |
| 2007/0033806 | A1 | 2/2007 | Orloff et al. |
| 2007/0182109 | A1 | 8/2007 | Considine et al. |
| 2011/0088269 | A1 | 4/2011 | Walker, Jr. et al. |
| 2011/0016724 | A1 | 6/2011 | Murgida |
| 2011/0173821 | A1 | 7/2011 | Hage et al. |
| 2012/0036658 | A1 | 2/2012 | Schaefer et al. |
| 2012/0311865 | A1 | 12/2012 | Hamilton et al. |
| 2014/0116211 | A1 | 5/2014 | Griffin et al. |
| 2014/0165800 | A1 | 6/2014 | Griffin et al. |
| 2014/0237830 | A1 | 8/2014 | Wilson et al. |
| 2015/0174774 | A1* | 6/2015 | Hodgson ..... B26B 21/14 30/34.2 |
| 2015/0174775 | A1* | 6/2015 | Hodgson ..... B26B 21/30 30/57 |
| 2015/0174776 | A1* | 6/2015 | Hawes ..... B26B 21/14 30/526 |

FOREIGN PATENT DOCUMENTS

| | | |
|---|---|---|
| CN | 201456045 | 5/2010 |
| DE | 102009050344 | 5/2011 |
| EP | 0300478 | 3/1990 |
| EP | 0885697 | 10/2003 |
| EP | 2227360 | 9/2010 |
| FR | 2660589 | 10/1991 |
| FR | 2663255 | 12/1991 |
| GB | 143536 | 3/1921 |
| GB | 612440 | 9/1939 |
| JP | 1996323065 | 12/1996 |
| JP | 2001340671 | 12/2001 |
| JP | 2004033295 | 2/2004 |
| JP | 2005000303 | 1/2005 |
| JP | 2006314720 | 11/2006 |
| RU | 2093349 | 10/1997 |
| WO | 9408761 | 4/1994 |
| WO | 9836880 | 8/1998 |
| WO | 0016951 | 3/2000 |

OTHER PUBLICATIONS

Petition for Inter Partes Review of U.S. Pat. No. 8,789,282 Under 35 U.S.C. Sec. 312 and 37 C.F.R. Sec. 42.104, dated Mar. 10, 2016, 59 pages.

Search Report—Corresponding EP Application No. 13794165, dated Jul. 20, 2016, 6 pages.

Search Report—Corresponding EP Application No. 13849856, dated Jun. 3, 2016, 8 pages.

* cited by examiner

DEDICATED ATTACHMENT SYSTEMS FOR CONSUMER PRODUCTS

CROSS-REFERENCE TO RELATED APPLICATIONS

This application is a continuation application of U.S. application Ser. No. 15/094,108, filed Apr. 8, 2016, now U.S. Pat. No. 9,669,555, granted on Jun. 6, 2017, which is a continuation application of U.S. application Ser. No. 13/869,535, filed Apr. 24, 2013, now abandoned, which claims priority from U.S. Provisional Application Ser. No. 61/718,328, filed Oct. 25, 2012, the entire disclosures of which are incorporated herein by reference.

BACKGROUND

Some consumer products include portions that are removable, to allow replacement and/or interchangeability. For example, shaving systems often consist of a handle and a replaceable blade unit in which one or more blades are mounted in a plastic housing. After the blades in a blade unit have become dull from use, the blade unit is discarded, and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

SUMMARY

In general, the invention features consumer products, e.g., shaving systems and toothbrushes, which have a replaceable portion, e.g., a shaving assembly or a toothbrush head, that is removably mounted on a handle. The consumer products described herein include keyed structures on the handle and replaceable portion, the relative placement of which creates a unique interaction between the two parts. This unique interaction may, for example, be used to provide a dedicated attachment system for each specific customer of the manufacturer of the consumer product.

In one aspect, the invention features a shaving system that includes a handle having a distal end and a proximal end, and a shaving assembly configured to removably interface with the handle, in which the distal end of the handle includes a keyed structure and the shaving assembly includes a complementary keyed structure.

Some implementations include one or more of the following features.

In some cases, the shaving assembly can interact with the handle in only a single predetermined orientation.

The complementary keyed structures may comprise male and female structures, e.g., ribs and channels. In some implementations, the handle includes a protrusion and the shaving assembly includes a cavity configured to receive the protrusion, and the keyed structures are provided on the protrusion and within the cavity. In such cases, the complementary keyed structures may include, for example, one or more channels or bores disposed on the protrusion and/or in the cavity, and one or more complementary ribs or pins disposed on the protrusion and/or in the cavity and configured to be received in the channels or bores when the shaving assembly is mounted on the handle.

In another aspect, the invention features a method for providing two or more shaving systems, each shaving system having a unique cartridge attachment. The method includes: (a) providing a first shaving system that includes a handle having a distal end and a proximal end, and a shaving assembly configured to removably interface with the handle, wherein the distal end of the handle includes a keyed structure and the shaving assembly includes a complementary keyed structure, the keyed structures having a first configuration; and (b) providing a second shaving system that includes a handle having a distal end and a proximal end, and a shaving assembly configured to removably interface with the handle, wherein the distal end of the handle includes a keyed structure and the shaving assembly includes a complementary keyed structure, the keyed structures having a second configuration different from the first configuration, such that the shaving assembly of the first shaving system cannot be attached to the handle of the second shaving system.

Some implementations may include any one or more of the features discussed above with respect to the first aspect of the invention.

In yet another aspect, the invention features a method of removably attaching a shaving assembly to a handle. The method includes (a) providing a handle having a distal end and a proximal end, the handle having a keyed structure at its distal end, and (b) mounting on the handle a shaving assembly configured to removably interface with the handle, the shaving assembly having a keyed structure that is complementary with that of the handle.

The invention also features methods of shaving utilizing the systems discussed herein. For example, in one aspect the invention features a method of shaving comprising contacting the skin with the shaving assembly of a shaving system, the shaving system comprising a handle having a distal end and a proximal end, and a shaving assembly configured to removably interface with the handle, wherein the distal end of the handle includes a keyed structure and the shaving assembly includes a complementary keyed structure.

DETAILED DESCRIPTION

The present disclosure relates generally to consumer products and, in particular, to shaving systems with interchangeable shaving assemblies. In one embodiment, the present disclosure features a reusable consumer product system having an interchangeable pivoting shaving assembly.

Figure 1:
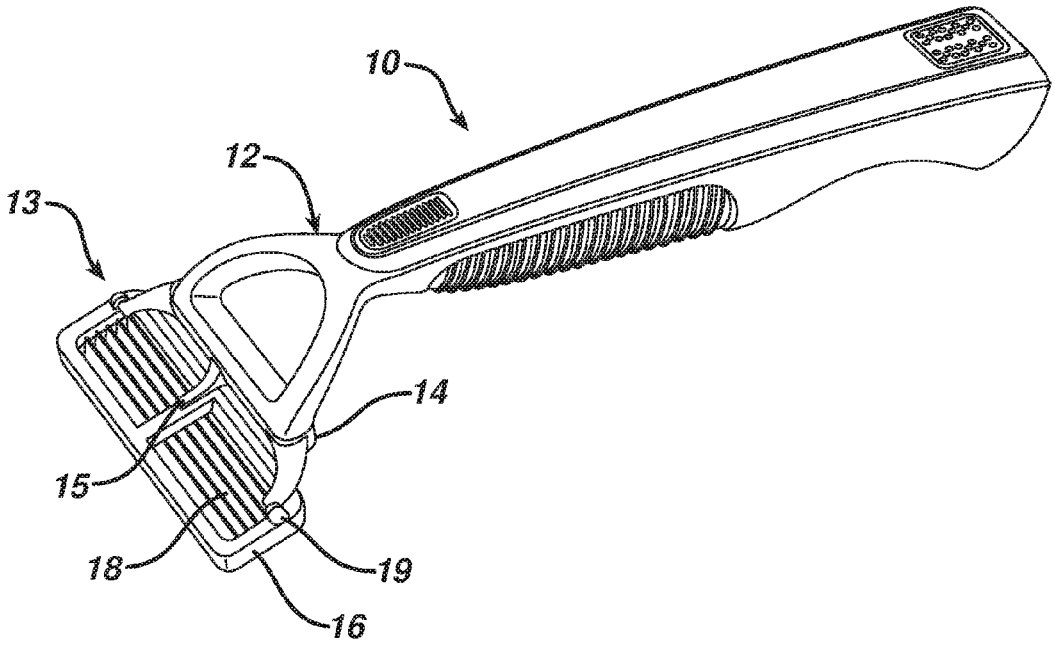
FIG. 1 is a perspective view according to one embodiment.

Referring to FIG. 1, a shaving system 10 includes a handle 12 and a shaving assembly 13, which includes a handle interface element 14, and, mounted on the interface element, a blade unit 16, which includes a plurality of blades 18. The handle 12 provides a manner in which the shaving system can be manipulated and leverage can applied to achieve desired shaving results. The shaving assembly 13 would be sold to the user as a complete, replaceable unit.

Figure 6:
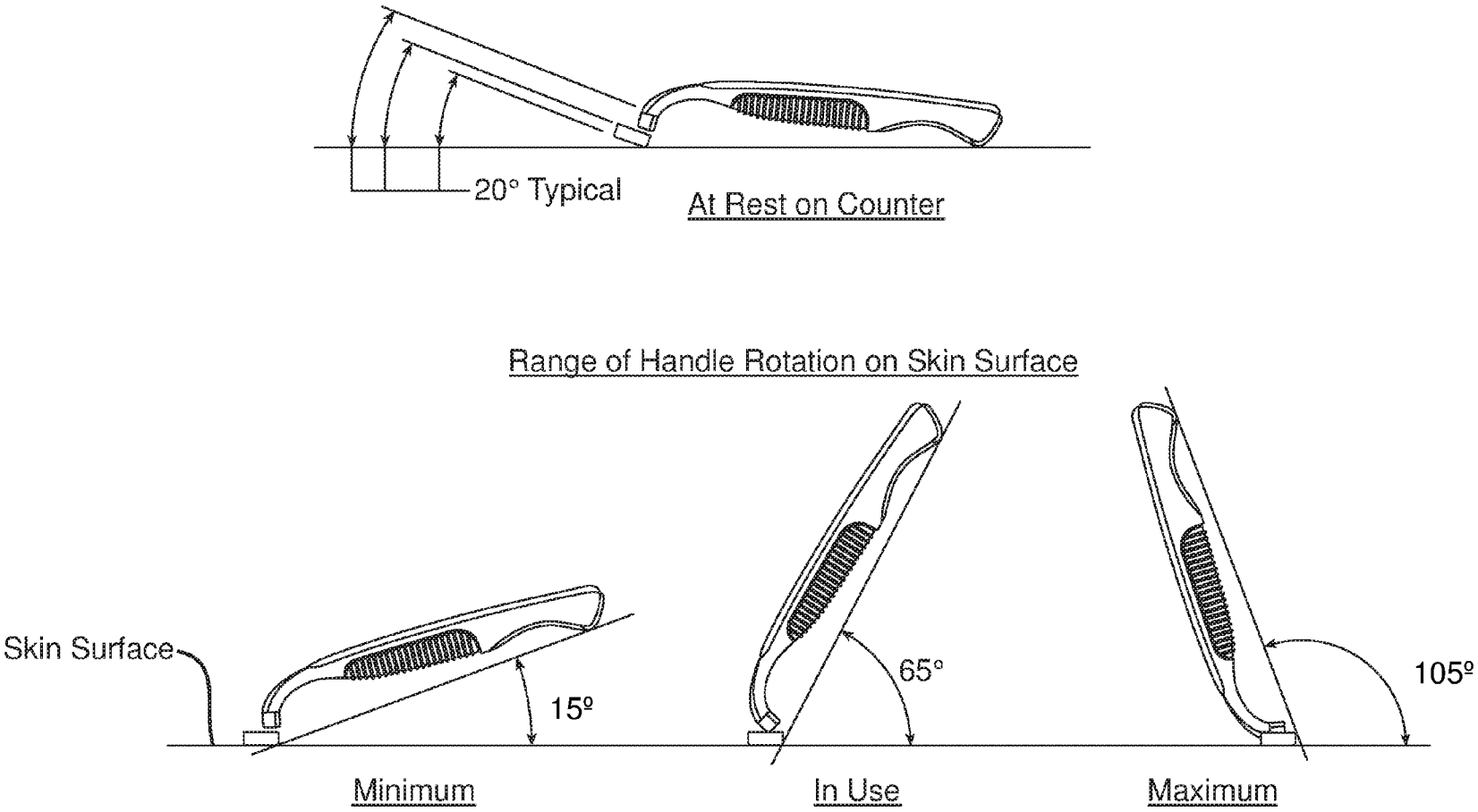
FIG. 6 is a diagram illustrating handle rotation with respect to a surface (skin).

Referring to FIG. 1, the blade unit 16 is configured with pivots 19 to allow controlled, single-plane articulation. Pivoting of the blade unit 16 is about an axis that is generally parallel to the long axis of the blade unit 16, allowing the blade unit 16 to follow the contours of a user's skin during shaving. Preferably, during use the angle of blade unit 16 with respect to handle 12 ranges from approximately 15° to 105° (FIG. 6). The shaving assembly 13 is configured with a return element 15 which could be a pusher and follower type, or any desired type of return element that is configured to provide resistance during shaving and return the blade unit 16 to a "rest" position when it is not in contact with the user's skin.

Figure 1A:
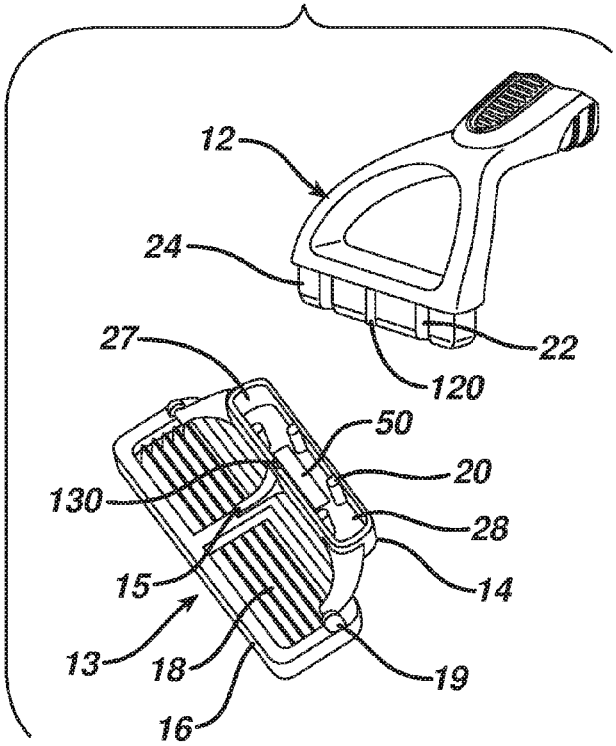
FIG. 1A is a perspective view according to one embodiment disassembled.
Figure 2:
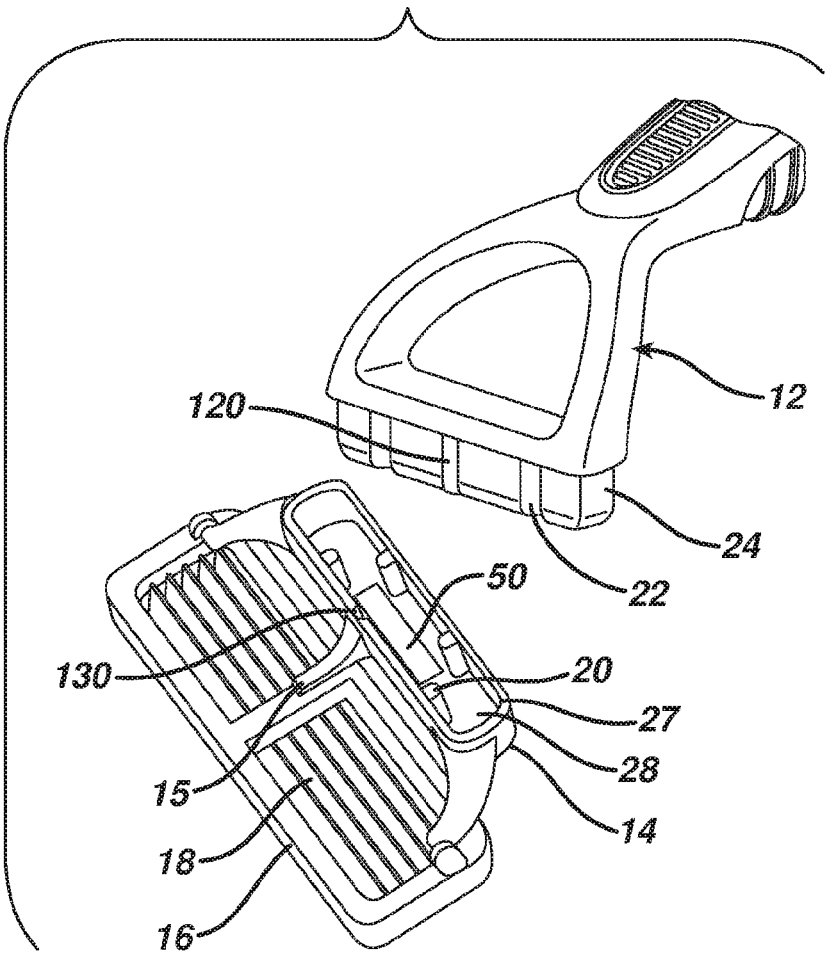
FIG. 2 is a perspective view according to one embodiment.
Figure 2A:
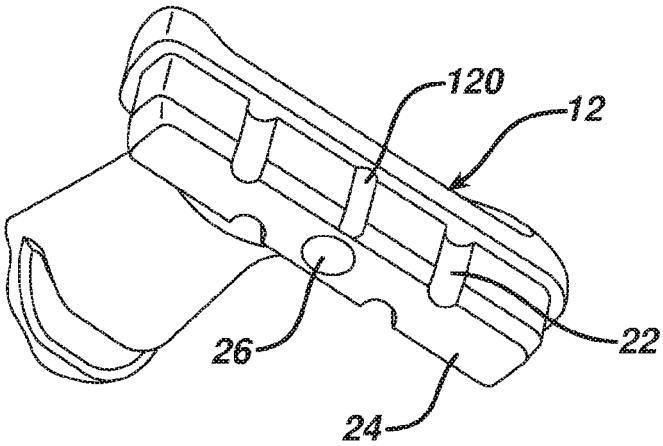
FIG. 2A is a bottom-up view of the handle of one embodiment.
Figure 3:
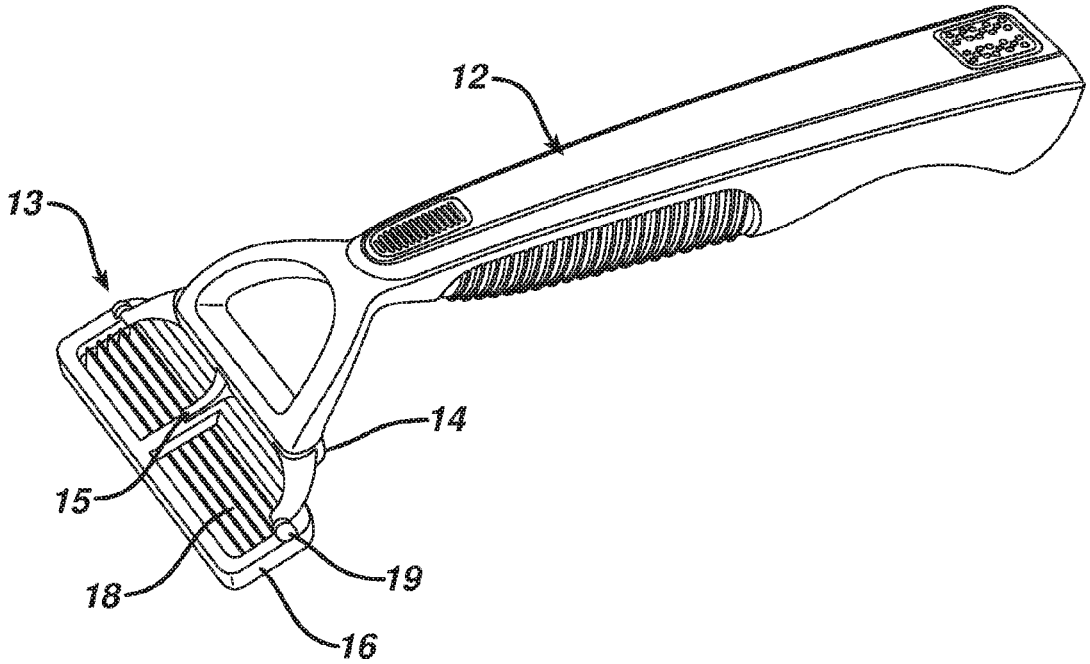
FIG. 3 is a perspective view according to another embodiment.
Figure 3A:
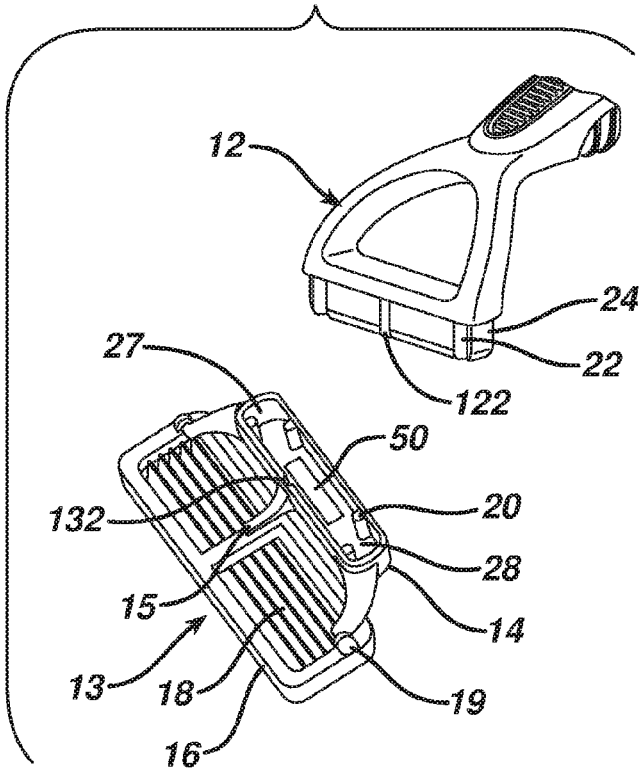
FIG. 3A is a perspective view of an alternate embodiment disassembled.

Referring to FIGS. 1A, 2, 2A, the handle interface element 14 is configured with an asymmetrical cavity 28 designed to receive an appendage 24 on the distal end of the handle 12 in a predetermined manner such that only one orientation is possible.

Figure 4:
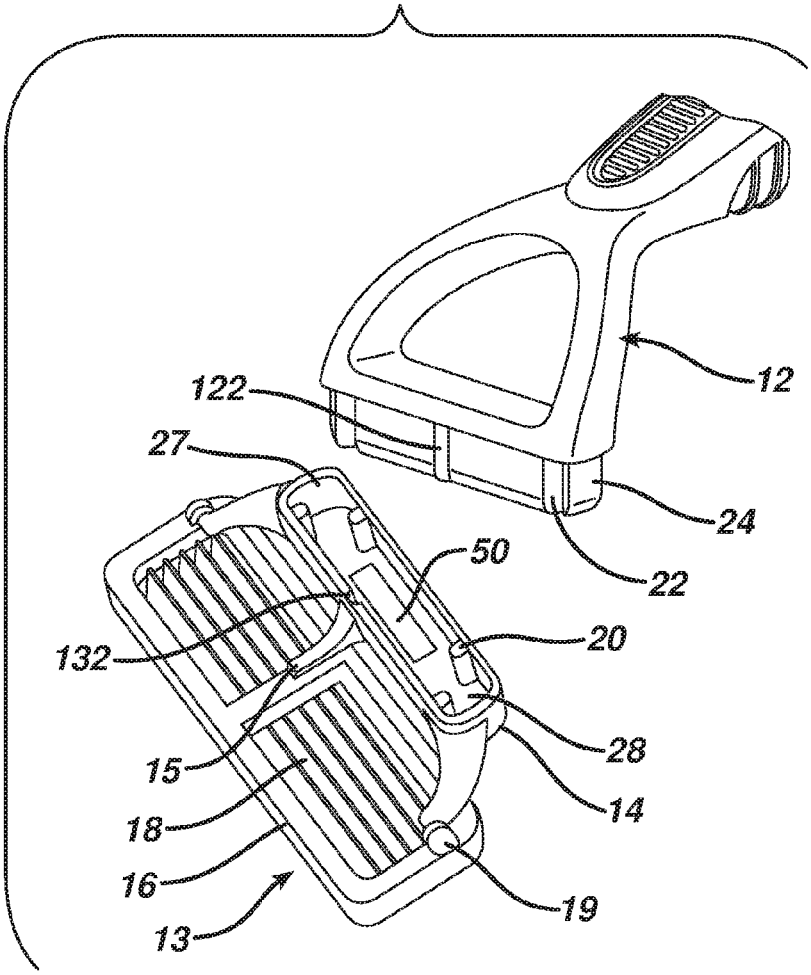
FIG. 4 is a perspective view of an alternate embodiment disassembled.
Figure 4A:
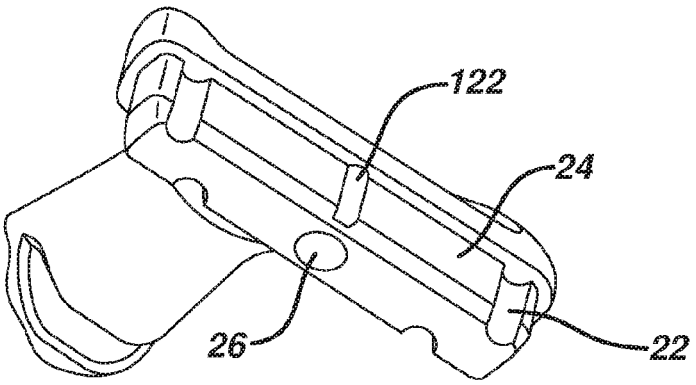
FIG. 4A is a bottom-up view of the handle of an alternate embodiment.

An attachment system is provided to allow the shaving assembly to be removably attached to the handle 12. In the embodiment shown, the handle interface element 14 and handle 12 include corresponding magnetic 26 (FIGS. 2A, 4A) and ferrous elements 50 (FIGS. 1A, 2, 3A, 4), which interface in the manner discussed in U.S. Ser. No. 61/651,732, filed May 25, 2012, the full disclosure of which is incorporated herein by reference. If desired, other attachment systems may be used, which will generally include corresponding structures or elements on the handle interface element 14 and appendage 24 of handle 12, and could be accomplished in a number of manners, such as by a mechanical locking mechanism.

The attachment system is complemented by the engagement of keyed structures on the appendage and cavity. In the embodiment shown, a plurality of semi-cylindrical ribs 20 extend inward from surface 27 of cavity 28. The appendage 24 is configured with a plurality of corresponding channels 22. Additionally, a channel 130 is configured on surface 27 of cavity 28, which corresponds to a rib 120 on the appendage 24 of the handle. The channel 130 and rib 120 are optional, and may be omitted if desired.

The interaction between the ribs 20 and channels 22, and the channel 130 and rib 120, if provided, enhances the ability of the attachment system to resist torsional forces incurred while shaving.

Figure 7:
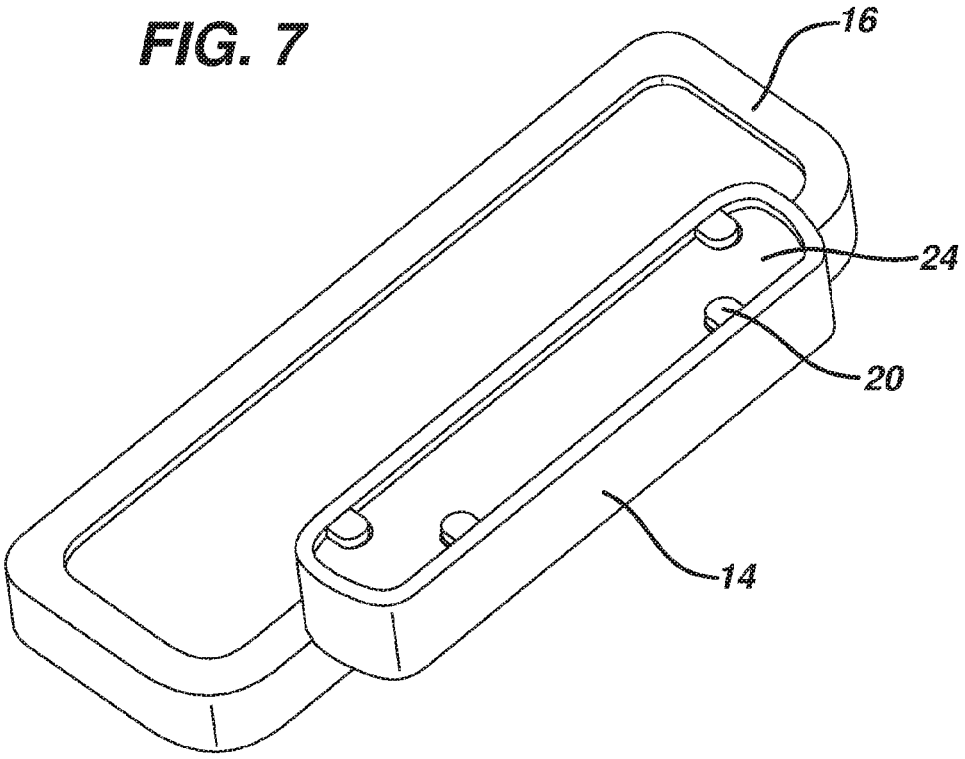
FIG. 7 is a diagrammatic view of a shaving assembly and the appendage portion of the handle, with the remainder of the handle removed.
Figure 8:
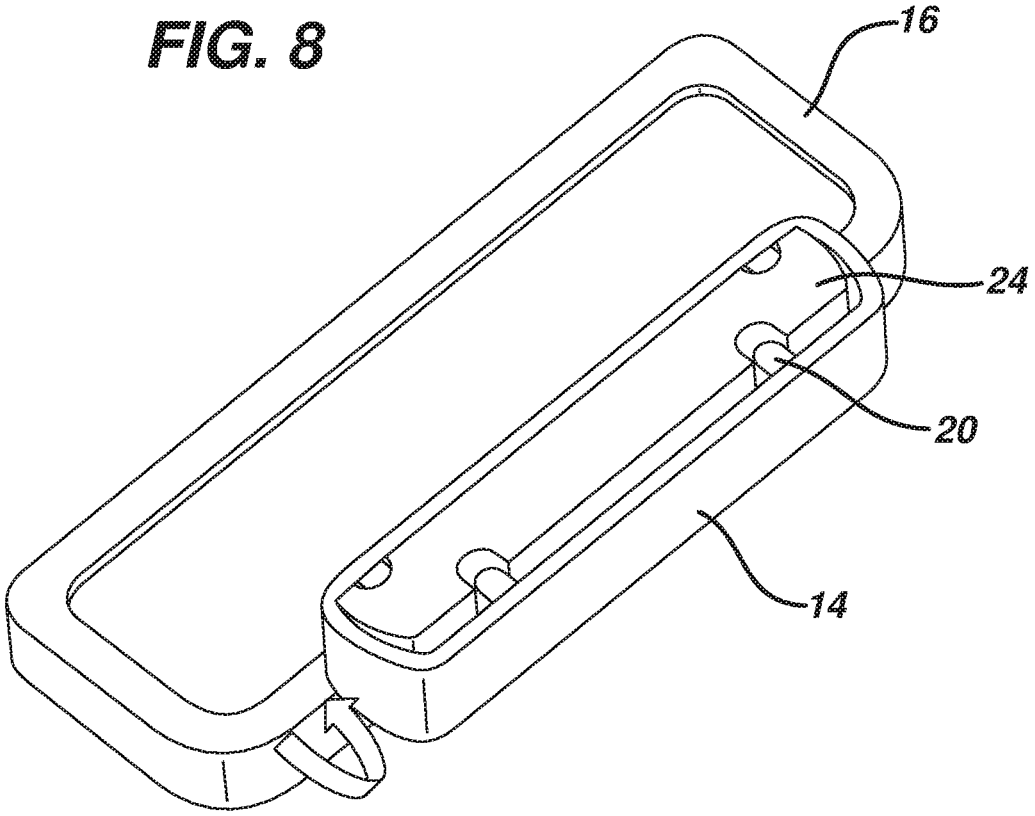
FIG. 8 is a view similar to that of FIG. 7 under different conditions.
Figure 9B:
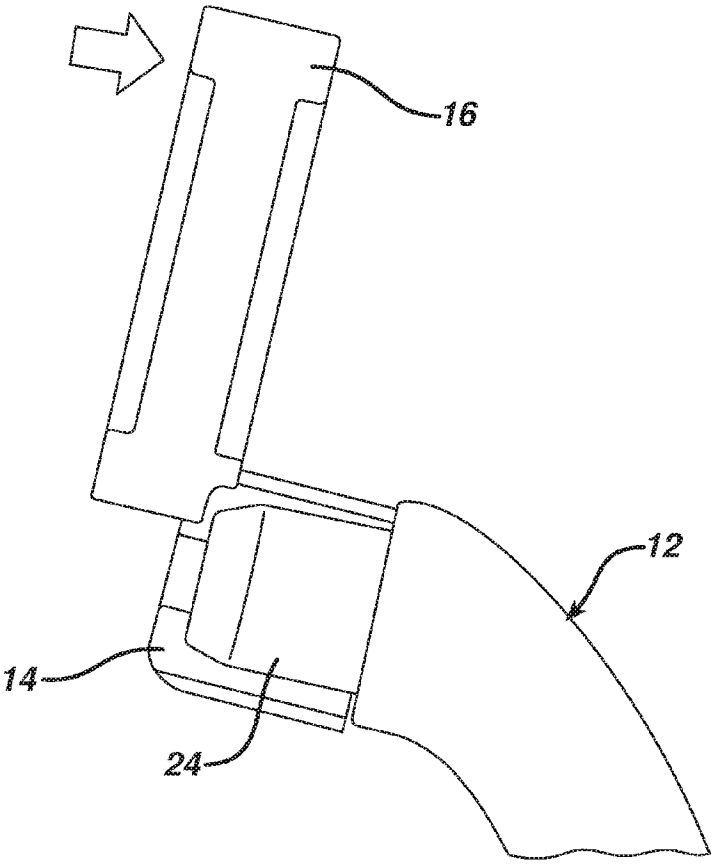
FIG. 9B is a view similar to FIG. 9A under different conditions.
Figure 9A:
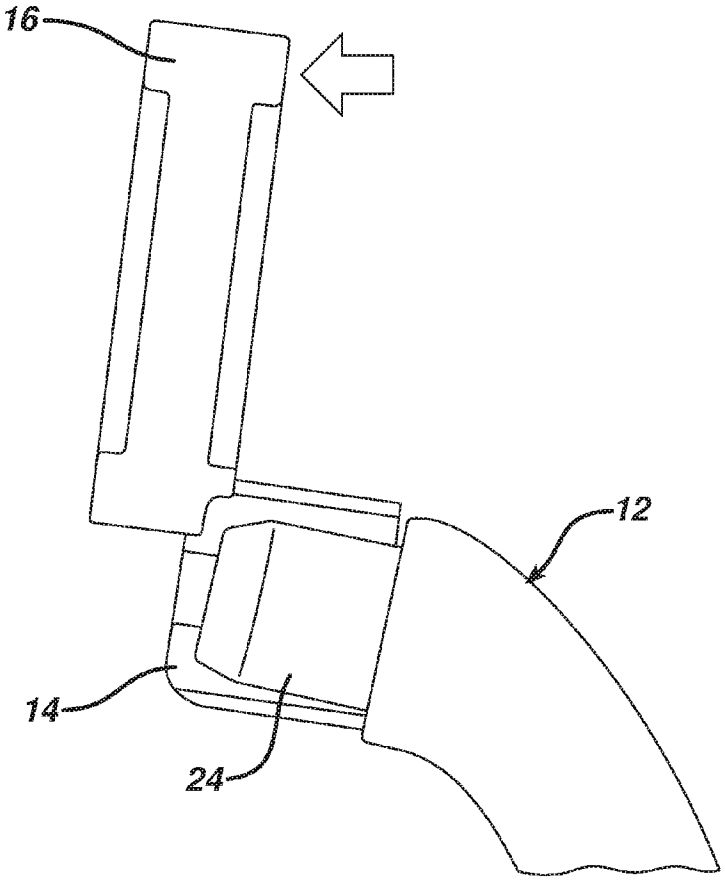
FIG. 9A is a diagrammatic sectional view of a shaving assembly and the handle.
Figure 10:
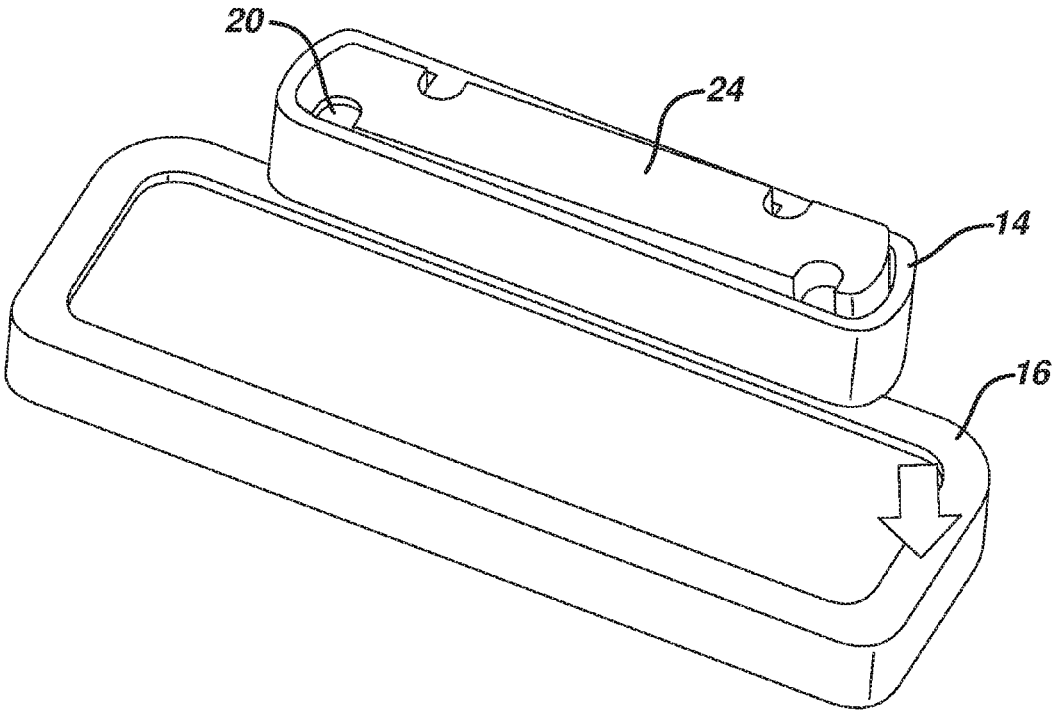
FIG. 10 is a view similar to FIG. 7 under different conditions.
Figure 11:
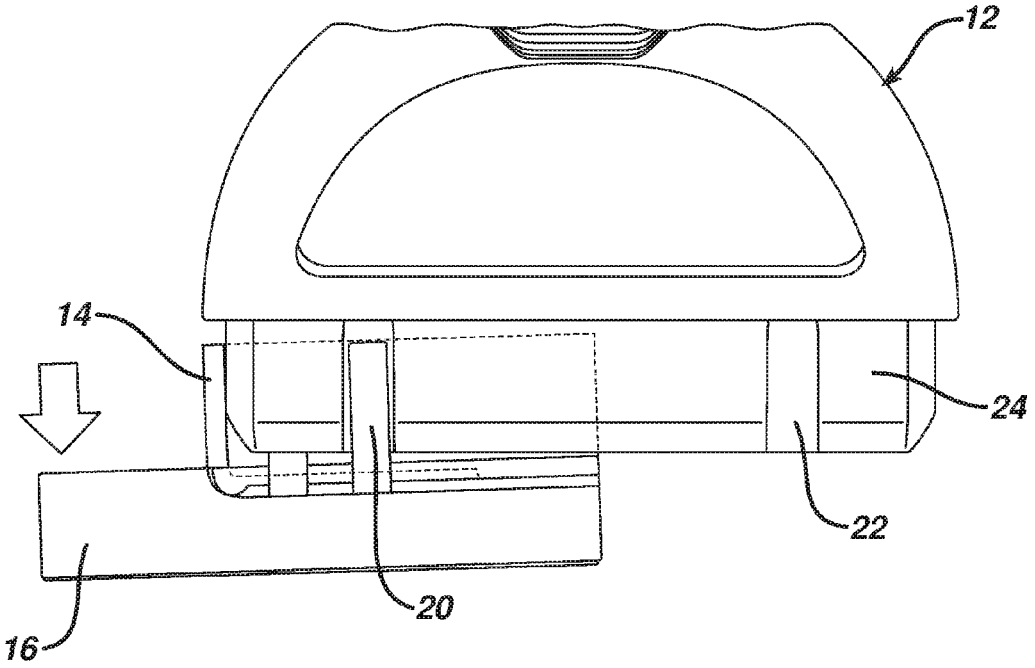
FIG. 11 is a diagrammatic frontal view of the handle and shaving assembly, with the right hand portion of the shaving assembly removed and the handle interface element translucent.

Referring to FIGS. 8-11, torsional forces may be applied to the shaving assembly 13 during use, for example during a tapping action performed during cleaning of the shaving assembly 13 or during shaving. These torsional forces may be about different axes, as shown in FIGS. 8-9 (about the long axis of the blade unit) and FIGS. 10-11 (about the long axis of the handle). In either case, the torsional force causes the ribs 20 to bind in the channels 22, due to the relatively small clearance between the ribs and the channels and the length of these structures. This binding action resists displacement of the shaving assembly 13 due to the torsional force. FIGS. 7, 8, and 10 illustrate the relative positioning of the appendage 24 in the cavity 28 when the system is at rest (FIG. 7), subjected to the force shown in FIGS. 9A-9B (FIG. 8), and subjected to the force shown in FIG. 11 (FIG. 10).

The clearance between the complementary features in the cavity 28 and the appendage 24 when no force is being applied to the shaving system 10 is preferably sufficiently large that the shaving assembly 13 is not retained in place by the interaction of these features, i.e., the ribs 20 are not press-fit into the channels 22. Retention is generally provided primarily by the attachment system.

Figure 5:
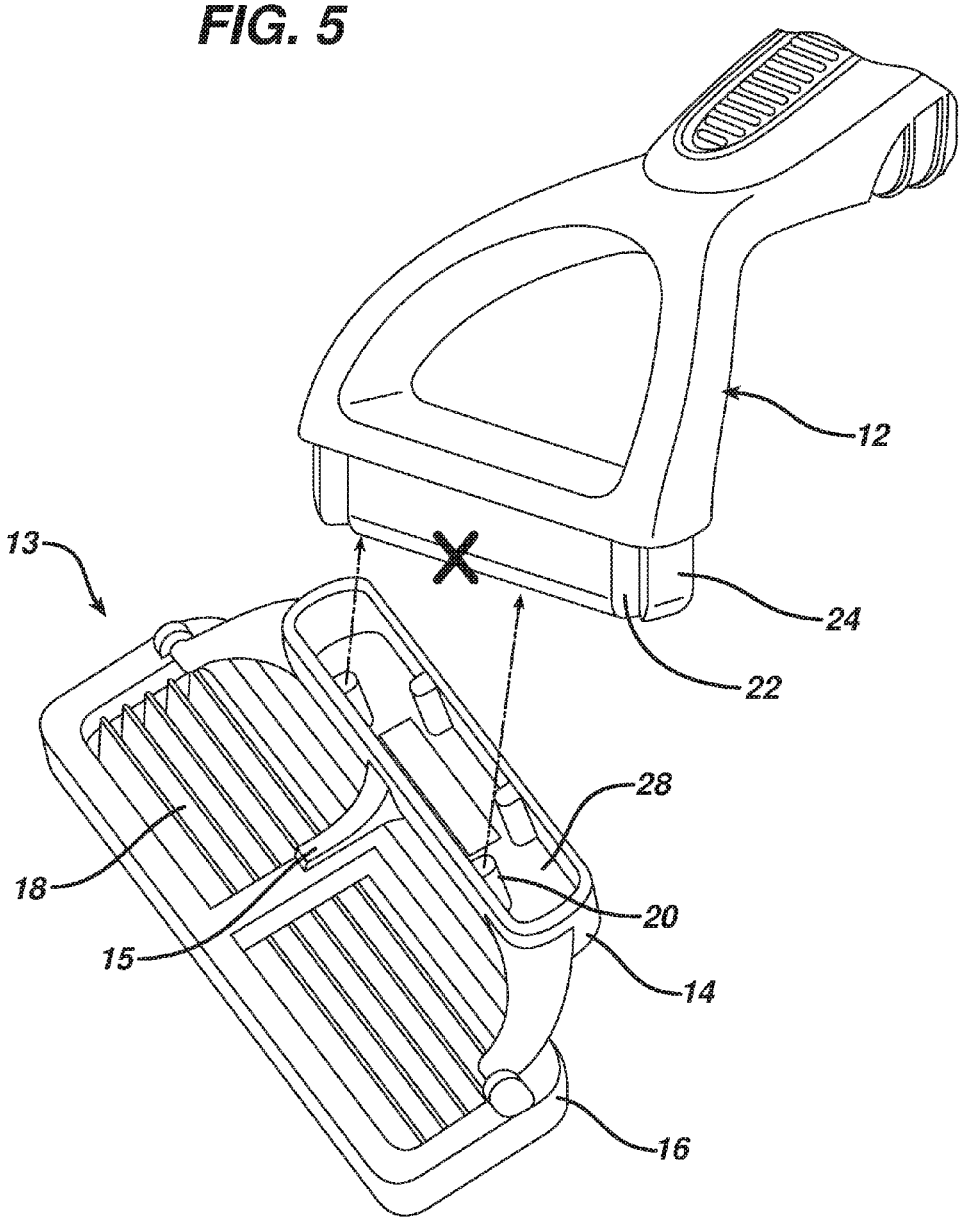
FIG. 5 is a perspective view illustrating the incompatibility of the handle of a particular interface configuration with the shaving cartridge of an alternate interface configuration.

An alternate embodiment is shown in FIGS. 3, 3A, 4, 4A, in which the ribs 20, 122 and corresponding channels 22, 132 are placed in a different orientation relative to those in the embodiment shown in FIGS. 1, 1A, 2, 2A. This alternative configuration renders the shaving assembly of this embodiment incompatible with the handle of the first embodiment, and vice versa. Thus, the keyed structures of each embodiment create a unique blade unit-handle interaction, providing a dedicated cartridge-handle system for each specific customer of the manufacturer of the shaving systems. FIG. 5 illustrates the incompatibility of a handle 12 and a shaving assembly 13 based on differing rib 20 and corresponding channel 22 arrangements.

The handle 12, shaving assembly 13, and other parts of system 10 could be made of any suitable material including, for example, polyethylene terephthalate (PET or PETE), high density (HD) PETE, thermoplastic polymer, polypropylene, oriented polypropylene, polyurethane, polyvinyl chloride (PVC), polytetrafluoroethylene (PTFE), polyester, high-gloss polyester, metal, synthetic rubber, natural rubber, silicone, nylon, polymer, wood, antibacterial or antimicrobial materials, insulating, thermal, other suitable sustainable or biodegradable materials, or any combination thereof according to one embodiment of the present disclosure.

Other Embodiments

A number of embodiments have been described. Nevertheless, it will be understood that various modifications may be made without departing from the spirit and scope of the disclosure.

For example, while a rib and channel embodiment is illustrated, many alternative corresponding shape configurations could be utilized to ensure unique, key-lock interactions between the handle and the shaving cartridge. For example, one alternative configuration could feature pins and bores. Moreover, rather than a plurality of keyed structures on each of the appendage and cavity, the keyed structures could be in the form of a single structure on each of the appendage and cavity, e.g., a single larger pin and a corresponding single receiving bore. Alternatively, the shape of the appendage could be keyed to the shape of the receiving cavity on the interface element.

Another embodiment could feature utilization of a combination of similar or dissimilar keyed structures on either the appendage or the cavity. For example, ribs and channels could be configured on the appendage together with their corresponding structures configured on the cavity. In addition, a variety of different keyed structures could be utilized in the same embodiment.

Another embodiment could feature alternative placements of the ferrous element and corresponding magnet. For example, while the ferrous element was shown in the cavity of the handle interface element of the shaving assembly, it could be integrated into the handle. Similarly, the magnet could be integrated into the shaving assembly instead of the handle.

As another example, while the appendage is on the handle and the cavity is on the interface element in the embodiments described above, in other embodiments the handle may include a cavity and an appendage may be provided on the interface element.

Figure 12:
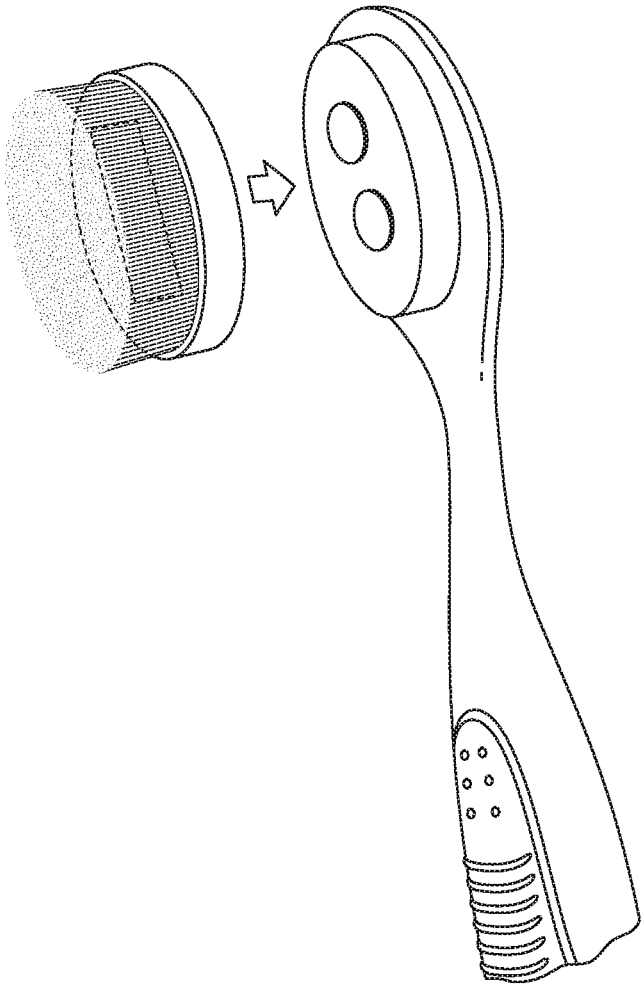
FIG. 12 is a diagrammatic representation of the magnetic retention system utilized with a toothbrush.

Additionally, as discussed above, the keyed structures may be used on other consumer products, for example on a manual or electric toothbrush having a removable head. An example of the use of the keyed structures on a toothbrush is shown in FIG. 12. Like the shaving systems discussed above, the toothbrush has an attachment system that includes a magnetic element (in this case two small magnets) and a corresponding ferrous element (a metal strip). Also like the shaving systems, the toothbrush includes an appendage on the handle and a corresponding cavity on the head that is configured to receive the appendage. The cavity and appendage include keyed elements (not shown), which may be arranged in the manner shown for the shaving systems (ribs and channels) or any other desired configuration. As discuss above with regard to the shaving systems, these keyed structures provide a dedicated attachment system for the head and handle, and in some cases may assist the attachment system in resisting disengagement during use.

Accordingly, other embodiments are within the scope of the following claims.

What is claimed is:

1. A shaving system comprising:

a handle having a distal end including a protrusion having a pair of walls extending parallel to a longitudinal axis of the protrusion and a proximal end, and a shaving assembly, comprising an interface element configured to removably interface with the handle and a blade unit pivotably mounted on the interface element, the interface element defining a cavity having walls that oppose the walls of the protrusion, wherein the distal end of the handle includes a keyed structure and the shaving assembly includes a complementary keyed structure wherein the keyed structures are provided on both walls of the protrusion and in corresponding locations on both walls of the cavity.

2. The shaving system of claim 1 wherein the interface element can interact with the handle in only a single predetermined orientation.

3. The shaving system of claim 1 wherein the complementary keyed structures comprise male and female structures.

4. The shaving system of claim 1 wherein the keyed structures comprise ribs and channels.

5. The shaving system of claim 1 wherein the complementary keyed structures comprise one or more channels or bores disposed on the protrusion and/or in the cavity, and one or more complementary ribs or pins disposed on the protrusion and/or in the cavity and configured to be received in the channels or bores.

6. The shaving system of claim 1, wherein the complementary keyed structures include a mix of male and female structures on each of the distal end of the handle and the shaving assembly.

7. A shaving system comprising:

a handle having a distal end including a protrusion having a pair of walls extending parallel to a longitudinal axis of the protrusion and a proximal end, and a shaving assembly, comprising an interface element configured to removably interface with the handle and a blade unit pivotably mounted on the interface element, the interface element defining a cavity having walls that oppose the walls of the protrusion, wherein the distal end of the handle includes a keyed structure and the shaving assembly includes a complementary keyed structure, and wherein the complementary keyed structures comprise one or more channels or bores disposed on the protrusion and/or in the cavity, and one or more complementary ribs or pins disposed on the protrusion and/or in the cavity and configured to be received in the channels or bores.

* * * * *